United States Patent [19]

Kishida

[11] 4,454,373

[45] Jun. 12, 1984

[54] BUSHING FOR GAS-INSULATED ELECTRICAL EQUIPMENT

[75] Inventor: Mitsuhiro Kishida, Itami, Japan

[73] Assignee: Mitsubishi Denki Kabushiki Kaisha, Tokyo, Japan

[21] Appl. No.: 442,430

[22] Filed: Nov. 17, 1982

[30] Foreign Application Priority Data

Nov. 20, 1981 [JP] Japan ..... 56-187254

[51] Int. Cl.[3] ..... H01B 17/28; H01B 17/36

[52] U.S. Cl. ..... 174/31 R; 174/143

[58] Field of Search ..... 174/18, 19, 20, 31 R, 174/76, 142, 143

[56] References Cited

FOREIGN PATENT DOCUMENTS 54-18720 7/1979 Japan ..... 174/143

OTHER PUBLICATIONS

International Application (PCT), WO 80/00762, Published Apr. 17, 1980, McConnel et al.

*Primary Examiner*—Laramie E. Askin

*Attorney, Agent, or Firm*—Wenderoth, Lind & Ponack

[57] ABSTRACT

A bushing in which a conductor penetrates through the center of a porcelain tube of which the one end is closed, the other end of the porcelain tube is closed by a cone-shaped insulation spacer which protrudes into the porcelain tube and which also supports the conductor, a capacitor cone is disposed to surround the conductor and a predetermined portion of the insulation spacer in the porcelain tube, an insulating material is charged into the porcelain tube, the side opposite to the capacitor cone relative to the insulation spacer is coupled to a container which is filled with an insulating gas having a predetermined pressure and which accommodates electrical equipment, and the conductor is connected to the electrical equipment.

4 Claims, 2 Drawing Figures

BUSHING FOR GAS-INSULATED ELECTRICAL EQUIPMENT

BACKGROUND OF THE INVENTION

The present invention relates to a bushing used for a lead port of gas-insulated electrical equipment of a power substation of the construction in which the equipment is accommodated in a sealed container that is filled with an insulating gas.

A gas bushing is usually used for the lead port of gas-insulated electrical equipment. The interior of the gas bushing is filled with an insulating gas at a high pressure which is equal to the pressure in the gas-insulated electrical equipment, while a high tension is applied to the central conductor. If a material impinges upon a porcelain tube in the gas bushing that is used under the above-mentioned condition, or if flashover develops along the contaminated surface, or if electric insulation breaks down in the bushing, the porcelain tube may be destroyed and the high pressure insulating gas filling the container may discharge at once. Therefore, fractured pieces of the porcelain tube scatter around and come into collision with the neighboring equipment, giving rise to the occurrence of chain-like destruction phenomenon which may result in the destruction of the whole substation. In particular, in the 500-kV systems and in the 1000-kV systems that will be put into operation in the future, bushings having large volumes will be used, and the insulating gas will have increased compression energy. Therefore, destruction of a porcelain tube could result in tremendous secondary damage. In the 66- to 275-kV systems, the volume in the bushing could be small depending upon the class of voltage, and the compression energy will become small correspondingly. However, the distance of the bushing from the neighboring equipment will decrease too depending upon the class of voltage. It can therefore be considered that the chain-like destruction may take place when a porcelain tube is destroyed, irrespective of the class of voltage.

In order to minimize the secondary damage that may result when a porcelain tube of the gas bushing is destroyed, the inventor of the present invention has previously proposed in U.S. application Ser. No. 322,665 filed Nov. 18, 1981, entitled "Bushing for Gas-Insulated Electrical Equipment" the construction in which an insulation cylinder is provided in the porcelain tube to reduce the volume that will be discharged to the open air when the porcelain tube is destroyed in order to limit the discharge of energy, in an attempt to reduce the compression energy that will be emitted as soon as the porcelain tube is destroyed.

That is, as shown in FIG. 1, an insulation cylinder 5 is provided in a porcelain tube 2 so that the clearance 6 is minimized, the porcelain tube 2 having a central conductor 1 disposed at the center thereof, and metal flanges 3, 4 secured to the upper end and to the lower end thereof with cement. The upper end of the central conductor 1 and the upper metal flange 3 are hermetically sealed with a cover 7 at the upper end of the porcelain tube 2. An electrode 8 is provided in a mounting flange 9 to reduce the concentration of electric field, and is fastened onto a bushing-mounting portion 10. With this setup, the compression energy of gas contained in space of clearance 6 only will be discharged in case the porcelain tube 2 is destroyed by some cause. Therefore, the energy is not so great as to drive the fractured pieces of porcelain tube into distance. This may not give rise to the occurrence of chain-like destruction of equipment in the substation. The compression energy can be further reduced if the pressure in the clearance 6 is reduced. With the insulation cylinder 5 being inserted, however, the area for inserting the electrode 8 is narrowed compared with when there is no insulation cylinder 5. To uniformize the electric field in the porcelain tube, therefore, it becomes necessary to increase the diameter of the porcelain tube 2 to provide increased space for inserting the insulation cylinder 5.

SUMMARY OF THE INVENTION

In view of the above-mentioned circumstances, the object of the present invention is to improve the insulation bushing of FIG. 1. In other words, the object of the present invention is to prevent the fractured pieces of porcelain tube from flying in case an accident occurs, without increasing the size of the porcelain tube.

BRIEF DESCRIPTION OF THE DRAWINGS

In the drawings, the same reference numerals denote the same or corresponding portions.

DESCRIPTION OF THE PREFERRED EMBODIMENT

Figure 1:
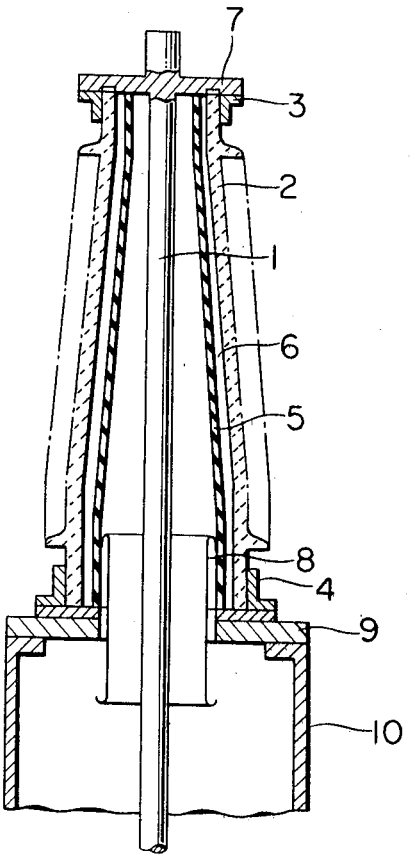
FIG. 1 is a sectional front view of a bushing for gas-insulated electrical equipment, that was proposed previously.
Figure 2:
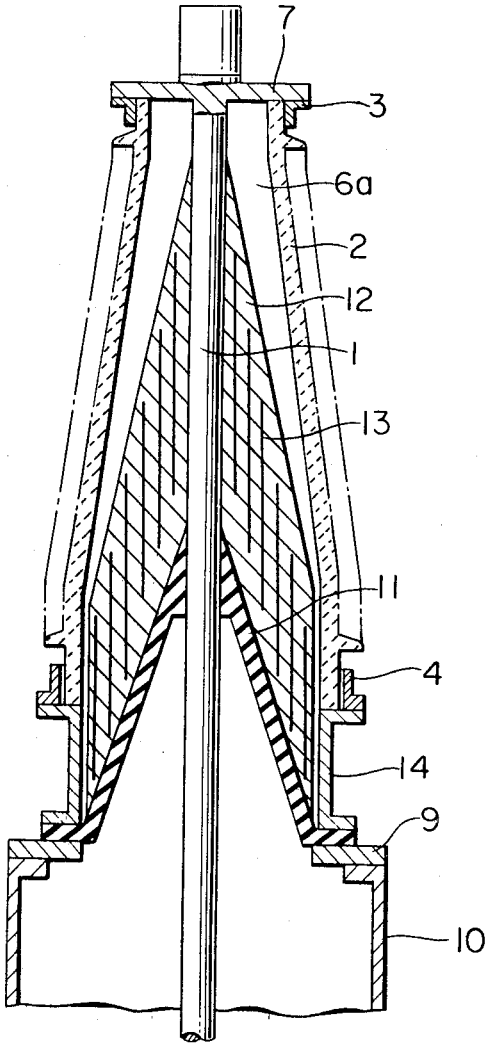
FIG. 2 is a sectional front view of a bushing for gas-insulated electrical equipment according to the present invention.

The invention will be described below in conjunction with the accompanying drawing. In FIG. 2, reference numeral 1 denotes a central conductor, reference numeral 2 denotes a porcelain tube having metal flanges 3 and 4 at the upper and lower ends thereof, reference numeral 7 denotes a cover for sealing and securing the upper end of the porcelain tube 2 and the upper end of the central conductor 1, reference numeral 11 denotes a cone-shaped insulation spacer which supports the central conductor 1, and which separates the gas in the gas-insulated electrical equipment from the gas in the gas bushing, reference numeral 12 denotes a capacitor cone which is obtained by applying a synthetic insulation paper or a synthetic resin film having good electrical insulation property on the surfaces of the central conductor 1 and the insulation spacer 11, and which contains a plurality of electrodes 13 which are inserted therein concentrically at such positions that the electric field is uniformly distributed on the inner side and outer side thereof, reference numeral 14 denotes an intermediate metal fitting, and reference numeral 9 denotes a mounting flange.

In FIG. 2, the central conductor 1 and the insulation spacer 11 are formed in a hermetically sealed construction so that difference in pressure can be maintained. Further, clearance 6a between the inner diameter of the porcelain tube 2 and the capacitor cone 12 is filled with an insulating gas of a pressure which is so small that the porcelain tube 2 does not scatter even in case it is cracked.

As mentioned above, the porcelain tube 2 contains insulating gas of a low pressure. Therefore, even if the porcelain tube 2 is destroyed by some cause, the fractured pieces do not fly over long distances, and the chain-like destruction can be prevented. As shown in FIG. 2, furthermore, the capacitor cone 12 is provided on the cone-shaped insulation spacer 11, to provide sufficiently large dielectric strength despite the pressure of insulating gas being small in the porcelain tube 2. Moreover, the electric field is uniformly distributed on the inner side and on the outer side, and the withstand voltage increases on the outer side. The lower portion of the bushing is constructed in the same manner as the conventional gas bushing to support the conductor, as shown in FIG. 2. Therefore, the existing gas bushings can be easily replaced by the gas bushings which are constructed according to the present invention.

Further, by disposing the cone-shaped insulation spacer 11 so as to protrude into the porcelain tube 2, the creeping distance of the insulation spacer 11 can be lengthened to obtain sufficiently large dielectric strength without the need of downwardly stretching the bushing.

Furthermore, if a solid insulating material having elasticity, such as an organic compound, is charged between the inner side of the porcelain tube 2 and the capacitor 12, energy will be emitted in lesser amounts in case the porcelain tube 2 is destroyed by some cause, and the fractured pieces will not scatter vigorously. If a foamed material such as polystyrol resin, polyethylene resin or urethane resin, is charged, the fractured pieces can be prevented from scattering in case the porcelain tube is destroyed.

The bushing can also be utilized as a capacitor-type instrument transformer if voltage-dividing taps are provided in the capacitor portion.

According to the present invention as mentioned above, the conductor is supported by the porcelain tube of which the end on the side of the electric equipment is hermetically sealed by the cone-shaped insulation spacer which protrudes into the porcelain tube, the capacitor cone is so disposed as to surround the conductor in the porcelain tube and a predetermined portion of the insulation spacer, and the insulating material is charged in the porcelain tube, thereby to realize a bushing of a small size which has increased dielectric strength, and of which the porcelain tube does not scatter even in case it is destroyed.

What is claimed is:

1. A bushing for gas-insulated electrical equipment comprising:

a porcelain tube having one closed end;

a central conductor which penetrates through the center of said porcelain tube;

an insulation spacer having a conical shape protruding into said porcelain tube and closing the other end of said porcelain tube, and which supports said central conductor and increases the dielectric strength of said bushing;

a cone-shaped capacitor which surrounds said insulation spacer and a portion of said central conductor;

means, including an insulation spacer-mounting flange, for supporting said porcelain tube on the upper portion of a gas-insulated container which accommodates electric equipment to be connected to said central conductor; and an insulating material contained in said porcelain tube, surrounding said capacitor.

2. A bushing for gas-insulated electrical equipment according to claim 1, wherein said insulating material is a gas which is the same as the insulating gas in said gas-insulated container, and which has a pressure smaller than the gas in said container.

3. A bushing for gas-insulated electrical equipment according to claim 1, wherein said insulating material is an insulating substance having elasticity.

4. A bushing for gas-insulated electrical equipment according to claim 1, wherein said insulating material is an insulating substance which is composed of a foamed material.

* * * * *